United States Patent [19]

Shannon et al.

[11] Patent Number: 5,027,836

[45] Date of Patent: Jul. 2, 1991

[54] INSULATED SMOKING ARTICLE

[75] Inventors: Michael D. Shannon, Winston-Salem; Chandra K. Banerjee, Pfafftown; Ernest G. Farrier; Andrew J. Sensabaugh, Jr., both of Winston-Salem, all of N.C.

[73] Assignee: R. J. Reynolds Tobacco Company, Winston-Salem, N.C.

[21] Appl. No.: 198,725

[22] Filed: May 23, 1988

Related U.S. Application Data

[63] Continuation of Ser. No. 684,537, Dec. 21, 1984, abandoned.

[51] Int. Cl.[5] ..... A28D 1/02; A24D 1/18

[52] U.S. Cl. ..... 131/194; 131/195; 131/365; 131/359; 131/335

[58] Field of Search ..... 131/194, 359, 369, 365, 131/195

[56] References Cited

U.S. PATENT DOCUMENTS

| | | | |
|---|---|---|---|
| 1,529,181 | 1/1926 | Holmes . | |
| 1,581,619 | 4/1926 | Sulzberger . | |
| 1,770,616 | 7/1930 | Kean . | |
| 2,020,646 | 11/1935 | Hornstein | 92/21 |
| 2,098,619 | 2/1936 | Finnell . | |
| 2,471,116 | 5/1949 | Newberger . | |
| 2,890,704 | 6/1959 | Lamm . | |
| 2,907,686 | 10/1959 | Siegel . | |
| 2,998,012 | 8/1961 | Lamm . | |
| 3,220,418 | 11/1965 | Cohn . | |
| 3,258,015 | 6/1966 | Ellis . | |
| 3,356,094 | 12/1967 | Ellis . | |
| 3,419,013 | 12/1968 | Calhoun . | |
| 3,516,417 | 6/1970 | Moses . | |
| 3,614,956 | 10/1971 | Thornton . | |
| 3,738,374 | 6/1973 | Bennett | 131/359 |
| 3,886,954 | 1/1974 | Hannema et al. . | |

(List continued on next page.)

FOREIGN PATENT DOCUMENTS

| | | |
|---|---|---|
| 276250 | 6/1972 | Australia . |
| 2057421 | 8/1983 | France . |
| 2057422 | 8/1983 | France . |
| 35-9894 | 7/1979 | Japan . |
| 220072 | 4/1968 | Sweden . |
| 956544 | 2/1956 | United Kingdom . |
| 1185887 | 3/1970 | United Kingdom . |
| 1597106 | 9/1981 | United Kingdom . |

OTHER PUBLICATIONS

Kirk-Othemer, Encyclopedia of Chemical Technology, 3:267-278 (1978).

Ames et al., *Mutation Research*, 113:173-215 (1983).

Nago et al., *Mutation Research*, 42:335-342 (1977).

Guinness World Book of Records, pp. 242-243 (1985 Edition).

(List continued on next page.)

*Primary Examiner*—V. Millia

*Attorney, Agent, or Firm*—Grover M. Myers; David G. Conlin

[57] ABSTRACT

The present invention preferably relates to an insulated smoking article which is capable of producing substantial quantities of smoke, both initially and over the useful life of the product, without significant thermal degradation of the aerosol former and without the presence of substantial pyrolysis or incomplete combustion products or sidestream smoke. Thus, the article of the present invention is able to provide the user with the sensations and benefits of cigarette smoking without burning tobacco. In addition, the article may be made virtually ashless so that the user does not have to remove any ash during use.

Preferred embodiments of the present smoking article comprise a short i.e., 30 mm or less (prior to smoking), combustible carbonaceous fuel element, a short heat stable, preferably carbonaceous, substrate longitudinally disposed relative to the fuel element bearing an aerosol forming substance, an efficient insulating means surrounding at least a portion of the fuel element and a relatively long mouthend piece. The fuel element, insulator and substrate are arranged in a heat exchange relationship, providing aerosol formation without significant degradation of the aerosol former.

90 Claims, 2 Drawing Sheets

U.S. PATENT DOCUMENTS 4,044,778 8/1977 Cohn .
4,061,147 12/1977 Falchi .
4,079,742 3/1978 Rainer .
4,219,032 10/1985 Tabatznik et al. .
4,284,089 8/1981 Ray .
4,286,604 9/1981 Ehretsmann .
4,289,149 11/1985 Kyriakou .
4,326,544 4/1982 Hardwick .
4,340,072 7/1982 Bolt .
4,347,855 9/1982 Lanzillotti et al. .
4,391,285 7/1983 Burnett et al. .
4,407,308 10/1983 Baker .
4,433,697 2/1984 Cline .
4,474,191 1/1986 Steiner .
4,474,191 10/1984 Steiner .
4,480,650 11/1984 Weinert .
4,481,958 1/1985 Rainer .
4,553,556 11/1985 Lephardt .
4,570,650 2/1986 Sirota .
4,574,821 3/1986 Fischer et al. .

OTHER PUBLICATIONS

Guinness World Book of Records, p. 194 (1966 Edition).

M. L. Reynolds, "Influence of Filter Additives on Smoke Composition", Rec. Adv. Tob. Sci. 4:47 (1978).

L. L. Lyerly, "Direct Vapor Chromatographic Determination --- of Triacetin in Cigarette Smoke", Tob. Sci. 50:26:(1967).

J. E. Kiefer et al., "Factors that Affect Elution of Plasticizer from Cigarette Filters", E. K. Pub. No. FTR-65 (1980).

Certain Materials Submitted to the Senate Committee on Commerce by Mr. Herbert A. Gilbert in Sept. of 1967.

Copy of the Newspaper Article which was Reproduced in the BBA Materials.

INSULATED SMOKING ARTICLE

This is a continuation of co-pending application Ser. No. 684,537 filed on Dec. 21, 1984 now abandoned.

BACKGROUND OF THE INVENTION

The present invention relates to a smoking article which produces an aerosol that resembles tobacco smoke which preferably contains no more than a minimal amount of incomplete combustion or pyrolysis products.

Many smoking articles have been proposed through the years, especially over the last 20 to 30 years. But none of these products has ever realized any commercial success.

Tobacco substitutes have been made from a wide variety of treated and untreated plant material, such as cornstalks, eucalyptus leaves, lettuce leaves, corn leaves, cornsilk, alfalfa, and the like. Numerous patents teach proposed tobacco substitutes made by modifying cellulosic materials, such as by oxidation, by heat treatment, or by the addition of materials to modify the properties of cellulose. One of the most complete lists of these substitutes is found in U.S. Pat. No. 4,079,742 to Rainer et al. Despite these extensive efforts, it is believed that none of these products has been found to be completely satisfactory as a tobacco substitute.

Many proposed smoking articles have been based on the generation of an aerosol or a vapor. Some of these products purportedly produce an aerosol or a vapor without heat. See, e.g., U.S. Pat. No. 4,284,089 to Ray. However, the aerosols or vapors from these articles fail to adequately simulate tobacco smoke.

Some proposed aerosol generating smoking articles have used a heat or fuel source in order to produce an aerosol. However, none of these articles has ever achieved any commercial success, and it is believed that none has ever been widely marketed. The absence of such smoking articles from the marketplace is believed to be due to a variety of reasons, including insufficient aerosol generation, both initially and over the life of the product, poor taste, off-taste due to the thermal degradation of the smoke former and/or flavor agents, the presence of substantial pyrolysis products and sidestream smoke, and unsightly appearance.

One of the earliest of these proposed articles was described by Siegel in U.S. Pat. No. 2,907,686. Siegel proposed a cigarette substitute which included an absorbent carbon fuel, preferably a 2½ inch stick of charcoal, which was burnable to produce hot gases, and a flavoring agent carried by the fuel, which was adapted to be distilled off incident to the production of the hot gases. Siegel also proposed that a separate carrier could be used for the flavoring agent, such as a clay, and that a smoke-forming agent, such as glycerol, could be admixed with the flavoring agent. Siegel's proposed cigarette substitute would be coated with a concentrated sugar solution to provide an impervious coat and to force the hot gases and flavoring agents to flow toward the mouth of the user. It is believed that the presence of the flavoring and/or smoke-forming agents in the fuel of Siegel's article would cause substantial thermal degradation of those agents and an attendant off-taste. Moreover, it is believed that the article would tend to produce substantial sidestream smoke containing the aforementioned unpleasant thermal degradation products.

Another such article was described by Ellis et al. in U.S. Pat. No. 3,258,015. Ellis et al. proposed a smoking article which has an outer cylinder of fuel having good smoldering characteristics, preferably fine cut tobacco or reconstituted tobacco, surrounding a metal tube containing tobacco, reconstituted tobacco, or other source of nicotine and water vapor. On smoking, the burning fuel heated the nicotine source material to cause the release of nicotine vapor and potentially aerosol generating material, including water vapor. This was mixed with heated air which entered the open end of the tube. A substantial disadvantage of this article was the ultimate protrusion of the metal tube as the tobacco fuel was consumed. Other apparent disadvantages of this proposed smoking article include the presence of substantial tobacco pyrolysis products, the substantial tobacco sidestream smoke and ash, and the possible pyrolysis of the nicotine source material in the metal tube.

In U.S. Pat. No. 3,356,094, Ellis et al. modified their original design to eliminate the protruding metal tube. This new design employed a tube made out of a material, such as certain inorganic salts or an epoxy bonded ceramic, which became frangible upon heating. This frangible tube was then removed when the smoker eliminated ash from the end of the article. Even though the appearance of the article was very similar to a conventional cigarette, apparently no commercial product was ever marketed.

In U.S. Pat. No. 3,738,374, Bennett proposed the use of carbon or graphite fibers, mat, or cloth associated with an oxidizing agent as a substitute cigarette filler. Flavor was provided by the incorporation of a flavor or fragrance into the mouthend of an optional filter tip.

U.S. Pat. Nos. 3,943,941 and 4,044,777 to Boyd et al. and British Patent 1,431,045 proposed the use of a fibrous carbon fuel which was mixed or impregnated with volatile solids or liquids which were capable of distilling or subliming into the smoke stream to provide "smoke" to be inhaled upon burning of the fuel. Among the enumerated smoke producing agents were polyhydric alcohols, such as propylene glycol, glycerol, and 1,3-butylene glycol, and glyceryl esters, such as triacetin. Despite Boyd et al.'s desire that the volatile materials distill without chemical change, it is believed that the mixture of these materials with the fuel would lead to substantial thermal decomposition of the volatile materials and to bitter off tastes. Similar products were proposed in U.S. Pat. No. 4,286,604 to Ehretsmann et al. and in U.S. Pat. No, 4,326,544 to Hardwick et al.

Bolt et al., in U.S. Pat. No. 4,340,072 proposed a smoking article having a fuel rod with a central air passageway and a mouthend chamber containing an aerosol forming agent. The fuel rod preferably was a molding or extrusion of reconstituted tobacco and/or tobacco substitute, although the patent also proposed the use of tobacco, a mixture of tobacco substitute material and carbon, or a sodium carboxymethylcellulose (SCMC) and carbon mixture. The aerosol forming agent was proposed to be a nicotine source material, or granules or microcapsules of a flavorant in triacetin or benzyl benzoate. Upon burning, air entered the air passage where it was mixed with combustion gases from the burning rod. The flow of these hot gases reportedly ruptured the granules or microcapsules to release the volatile material. This material reportedly formed an aerosol and/or was transferred into the mainstream aerosol. It is believed that the articles of Bolt et al., due in part to the long fuel rod, would produce insufficient aerosol from the aerosol former to be acceptable, especially in the early puffs. The use of microcapsules or granules would further impair aerosol delivery because of the heat needed to rupture the wall material. Moreover, total aerosol delivery would appear dependent on the use of tobacco or tobacco substitute materials, which would provide substantial pyrolysis products and sidestream smoke which would not be desirable in this type smoking article.

U.S. Pat. No. 3,516,417 to Moses proposed a smoking article, with a tobacco fuel, which was identical to the article of Bolt et al., except that Moses used a double density plug of tobacco in lieu of the granular or microencapsulated flavorant of Bolt et al. See FIG. 4, and col. 4, lines, 17–35. This article would suffer many of the same problems as the articles proposed by Bolt et al.

Thus, despite decades of interest and effort, there is still no smoking article on the market which provides the benefits and advantages associated with conventional cigarette smoking.

So called "fire safe" cigarettes are known, especially those coated with a ceramic paper made up of materials such as glass fibers. For example, Lamm, in U.S. Pat. Nos. 2,998,012 and 2,890,704, described cigarettes having an outer wrapper of "tissue paper thin" glass fibers. These coated cigarettes are purportedly nonflammable when carelessly discarded du to the ceramic paper layer. These cigarettes are also reported to be manufacturable on conventional cigarette making equipment as the thin ceramic paper does not interfere with processing conditions.

SUMMARY OF THE INVENTION

The present invention relates to a smoking article which is capable of producing substantial quantities of aerosol, both initially and over the useful life of the product, preferably without significant thermal degradation of the aerosol former and without the presence of substantial pyrolysis or incomplete combustion products or sidestream smoke. Thus, the article of the present invention is able to provide the user with the sensations and benefits of smoking without the necessity of burning tobacco.

These and other advantages are obtained by providing a smoking article which utilizes a fuel element, preferably of carbonaceous material, in conjunction with means for generating an aerosol, the fuel element and aerosol generating means being arranged such that heat generated by the burning fuel element is conducted to the aerosol generating means both during puffing and during smolder. At least a part of the fuel element is provided with a peripheral insulating means, such as resilient insulating fibers, which assist in retaining and directing the heat from the burning fuel element toward the aerosol generating means. Advantageously, the insulating means is at least 0.5 mm thick.

As used herein, and only for the purposes of this application, "aerosol" is defined to include vapors, gases, particles, and the like, both visible and invisible, and especially those components perceived by the user to be "smoke-like", generated by action of the heat from the burning fuel element upon substances contained within the aerosol generating means, or elsewhere in the article. As so defined, the term "aerosol" also includes volatile flavoring agents and/or pharmacologically or physiologically active agents, irrespective of whether they produce a visible aerosol.

In a preferred aspect of the present invention, the smoking article has a short, combustible carbonaceous fuel element, generally less than about 30 mm long, which is substantially free of volatile organic material. Preferably, the fuel element is less than about 15 mm in length. While not preferred, other fuel elements may be employed, such as tobacco substitutes, and the like. A physically separate aerosol generating means, such as a substrate, container or chamber containing an aerosol forming substance, is located in a conductive heat exchange relationship to the fuel element. Preferably, the heat exchange relationship is achieved by providing a heat conducting member such as a metal foil, which efficiently conducts or transfers heat from the burning fuel element to the aerosol generating means.

The smoking article of the present invention also utilizes an insulating means in order to direct heat flow and restrict heat loss through the periphery of the fuel element and optionally, the aerosol generator, thus increasing transfer of the heat generated by the burning fuel element to the aerosol generating means. Preferably, the insulating means is made up of at least one noncombustible layer of insulating material, which is provided around at least a part of the fuel element, and preferably also around at least a part of the aerosol generating means.

The smoking article of the present invention normally is provided with a mouthend piece including means, such as a longitudinal passage, for delivering the aerosol to the user. Advantageously, the article has the same overall dimensions as a conventional cigarette, and as a result, the mouthend piece and the aerosol delivery means usually extend over more than one-half the length of the article. Alternatively, the fuel element and the aerosol generating means may be produced without a built-in mouthend piece or aerosol delivery means for use with a separate, disposable or reusable mouthend piece.

Upon lighting, the fuel element generates heat which is used to volatilize the aerosol forming substance or substances contained in the aerosol generator. These volatile materials are then drawn toward the mouthend, and into the user's mouth, akin to the smoke of a conventional cigarette. Because the preferred fuel element is relatively short, the hot, burning fire cone is always close to the aerosol generator, thereby maximizing heat transfer to the aerosol generating means and the resultant production of aerosol. Heat transfer is also increased by the use of a heat conducting member, such as a metallic foil or a metallic enclosure for the aerosol generating means, which contacts or couples the fuel element and the aerosol generating means.

The use of an insulating means as a peripheral overwrap over at least a part of the fuel element, and advantageously at least a part of the aerosol generator, ensures good aerosol production by retaining and directing much of the heat generated by the burning fuel. Preferably, the insulating means extends over more than about one half of the length of the fuel element. More preferably, it extends over substantially the entire outer periphery of both the fuel element and the aerosol generating means. The insulating means may also form all or part of the mouthend piece of the article.

The present invention makes it possible to produce smoking articles which are so effectively insulated that any fire causing propensity is virtually eliminated and the periphery of the article does not become uncomfortably warm to touch during use. This may be accomplished by employing one or more layers of an insulating material as an insulating jacket, said jacket advantageously being at least 0.5 mm thick, preferably at least 1 mm thick. Such materials are preferably resilient and/or permeable to air. Preferred insulating materials include carbon or ceramic fibers. Preferably, the insulating material comprises noncombustible resilient fibers. The use of such fibers permits air to reach the periphery of the burning fuel element which supports combustion during smolder. Such fibers also help to simulate the appearance and feel of a conventional cigarette and may assist in the manufacture of the article. In addition, the use of a resilient insulating jacket of the preferred thickness permits the use of a small diameter fuel element, which is generally easier to ignite than a fuel element having a diameter approximating a conventional cigarette.

When the insulating means is fibrous, there is preferably employed a barrier means at the mouth end of the article. One such barrier means comprises an annular member of high density cellulose acetate tow which abutts the fibrous insulating means and which is sealed, preferably at the mouth end, with, for example, glue, to block air flow through the tow.

As used herein, the term "insulating means" applies to all materials which act primarily as insulators. Preferably, these materials do not burn during use, but they may include slow burning carbons and like materials, as well as materials which fuse during use, such as low temperature grades of glass fibers. The insulators have a thermal conductivity, in g-cal/(sec)(cm$^2$)(° C./cm), of less than about 0.05, preferably less than about 0.02, most preferably less than about 0.005. See, *Hackh's Chemical Dictionary,* 672 (4th ed., 1969) and Lange's *Handbook of Chemistry,* 10, 272–74 (11th ed., 1973). The term "insulating fibers" generally includes inorganic fibers such as those made out of glass, alumina, silica, vitreous materials, mineral wool, carbons, silicons, boron, and the like, including mixtures of these materials. Nonfibrous insulating materials, such as silica aerogel, pearlite, glass, and the like may also be used. These materials act primarily as an insulating jacket, retaining and directing a significant portion of the heat produced by the burning fuel element to the aerosol generator. Because the insulating jacket becomes hot adjacent to the burning fuel element, to a limited extent, it also may conduct heat toward the aerosol generating means.

In the preferred embodiments of the invention, the fuel element is either a pressed or extruded carbon mass, generally about 20 mm or less in length, which is provided with at least one longitudinal passage to aid heat transfer to the aerosol generator. The aerosol generator includes a metallic container, abutting the fuel element, enclosing one or more aerosol forming substances.

The smoking article of the present invention may also include a charge of tobacco which is used to add tobacco flavors to the aerosol. The tobacco may be placed at the mouth end of the aerosol generating means, or it may be mixed with the carrier for the aerosol forming substance. In some embodiments, tobacco may be used in lieu of a carrier for the aerosol forming substance. Other substances may be incorporated in a similar manner.

Preferred embodiments of the invention are capable of delivering at least 0.6 mg of aerosol, measured as wet total particulate matter (WTPM), in the first 3 puffs, when smoked under standard FTC smoking conditions which consist of a 35 ml puff of two seconds duration, followed by 58 seconds of smolder. More preferably, embodiments of the invention are capable of delivering 1.5 mg or more of aerosol in the first 3 puffs. Most preferably, embodiments of the invention are capable of delivering 3 mg or more of aerosol in the first 3 puffs when smoked under standard FTC smoking conditions. Moreover, preferred embodiments of the invention deliver an average of at least about 0.8 mg of WTPM per puff under standard FTC smoking conditions.

In addition to the aforementioned benefits, the preferred smoking article of the present invention provides an aerosol which is chemically simple, consisting essentially of air, oxides of carbon, water, and the aerosol former which carries any desired flavors or other desired volatile materials, and trace amounts of other materials. This aerosol has no significant mutagenic activity as measured by the Ames Test. In addition, the article may be made virtually ashless, so that the user does not have to remove any ash during use.

The preferred smoking article of the present invention is described in greater detail in the accompanying drawings and in the detailed description of the invention.

DETAILED DESCRIPTION OF THE PREFERRED EMBODIMENTS

Figure 1:
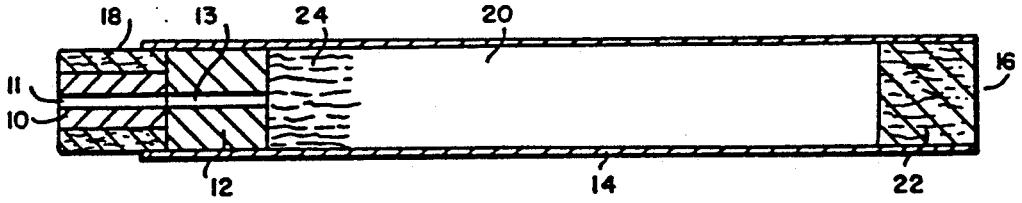
FIGS. 1 through 5 are sectional views of various embodiments of the invention.

The embodiment of the invention illustrated in. FIG. 1, which has about the same diameter as a conventional cigarette, includes a short, combustible carbonaceous fuel element 10, an abutting aerosol generating means 12, in the form of a carbon mass, and a foil-lined paper tube 14 which provides mouth end 16. In this embodiment, fuel element 10 is a pressure formed carbon rod, which is provided with one or more longitudinally extending holes 11. The fuel element 10, is surrounded by an insulating jacket of resilient fibers 18 to an outer diameter nearly that of a conventional cigarette. Carbon mass 12 is provided with one or more holes 13 and is impregnated with one or more aerosol forming substances, such as a mixture of propylene glycol and glycerin.

The foil-lined paper tube 14, which forms the mouth-end piece, surrounds carbon mass 12 and the rear periphery of the insulating jacket 18. The tube also forms an aerosol delivery passageway 20 between the carbon mass 12 and mouth end 16. For appearance sake, the article may also include an optional high porosity cellulose acetate filter 22, positioned at or near the mouth end 16.

The article illustrated in FIG. 1 also includes an optional mass of tobacco 24 which contributes flavors to the aerosol. This tobacco charge 24 may be placed at the mouth end of carbon mass 12, as shown in FIG. 1, or it may be placed in passageway 20, at a location spaced from the carbon mass.

Figure 2:
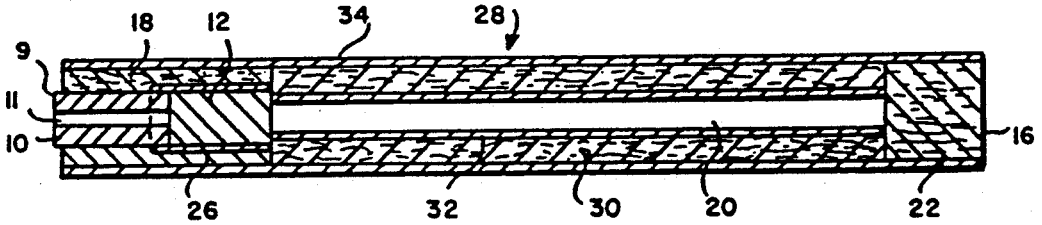

In the embodiment shown in FIG. 2, the fibrous insulating jacket 18 surrounds the periphery of both the fuel element 10 and the porous carbon mass 12. In this embodiment, the lighting end 9 of fuel element 10, extends slightly beyond the fiber jacket 18 for ease of lighting. Carbon mass 12 and the rear portion of the fuel element 10 are surrounded by a piece of aluminum foil 26. This embodiment is provided with a cellulose acetate tube 28, in place of the foil-lined tube of FIG. 1. This tube includes an annular section 30 of cellulose acetate tow surrounding an optional plastic, e.g., polypropylene tube 32. At mouth end 16 of this embodiment there is a low efficiency cellulose acetate filter plug 22. The combination of cellulose acetate tube 28, filter plug 22, and the jacketed fuel element/carbon mass are coupled by an overwrap of cigarette paper 34.

Figure 3:
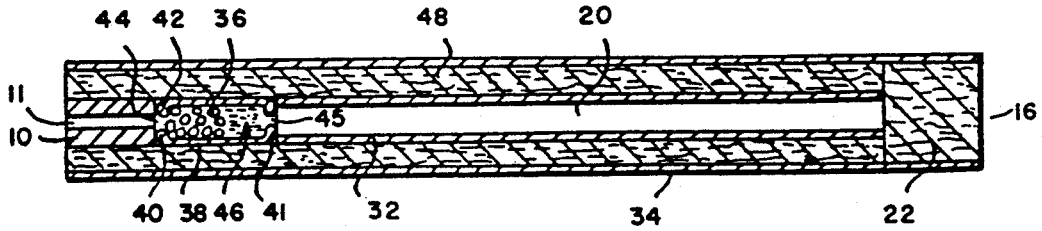

In the embodiment shown in FIG. 3, a grannular substrate 36 is used in lieu of the carbon mass 12. This substrate is contained within a metallic container 38 formed from a metal tube crimped in at ends 40 and 41, to enclose the substrate 36 and to inhibit migration of the aerosol former. Crimped end 40, at the fuel end, preferably abuts the rear end of the fuel element to provide conductive heat transfer. A void space 42 formed by end 40 also helps to inhibit migration of the aerosol former to the fuel element. Holes 44 and 45 are provided to permit passage of air and the aerosol forming substance. The metallic container 38 may also enclose a mass of tobacco 46 which may be mixed with the granular substrate 36 or used in lieu thereof. In this embodiment the fiberous insulating jacket 48 extends from the lighting end of fuel element 10 to the cellulose acetate filter plug 22. A plastic tube 32, e.g., polypropylene, is located inside the fiber jacket 48, between the metallic container 38 and the filter plug 22, providing a passageway 20 for the aerosol forming substance. This embodiment may be overwrapped with cigarette paper 34.

Figure 4:
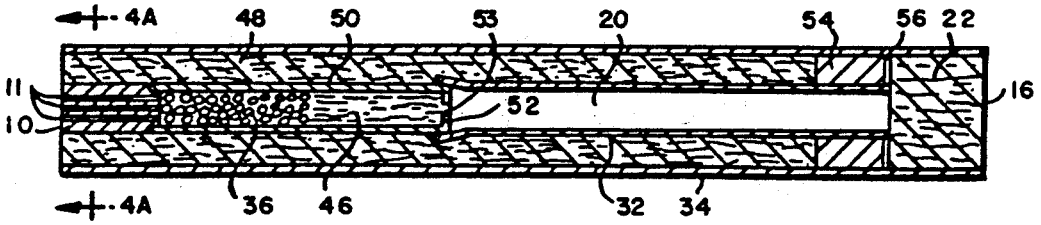
Figure 4A:
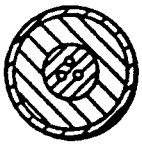
FIGS. 4A, 4B, and 4C are sectional views of various fuel element hole configurations useful in practicing the present invention.
Figure 4B:
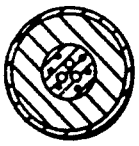
Figure 4C:
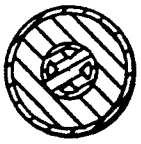

In the embodiment shown in FIG. 4, fuel element. 10 is provided with a plurality of holes 11. FIGS. 4A, 4B, and 4C illustrate various preferred placements of these fuel element holes. In this embodiment, the aerosol generating means 12 comprises a metallic container 50 which encloses a granular substrate 36 containing an aerosol forming substance, and/or tobacco 46. One end of the metallic container 50 overlaps the rear periphery of fuel element 10. The opposite end of container 50 is crimped in to form a wall 52, having a hole 53, thus permitting passage of air and the aerosol forming substance. A plastic tube 32 is fitted over the walled end of metallic container 50. One or more layers of resilient insulating fibers 48 are wrapped around the fuel element 10, metallic container 50, and most, if not all, of plastic tube 32. The mouthend portion of plastic tube 32 is surrounded by a section of high density cellulose acetate tow 54. A layer of glue 56, is applied to the mouth end of tow 54 to seal the tow and block air flow. A filter plug 22 is located contiguous thereto. The entire length of the article is overwrapped with cigarette paper 34. In a preferred embodiment, a perforated cigarette paper, such as ECUSTA 01788, is used.

Figure 5:
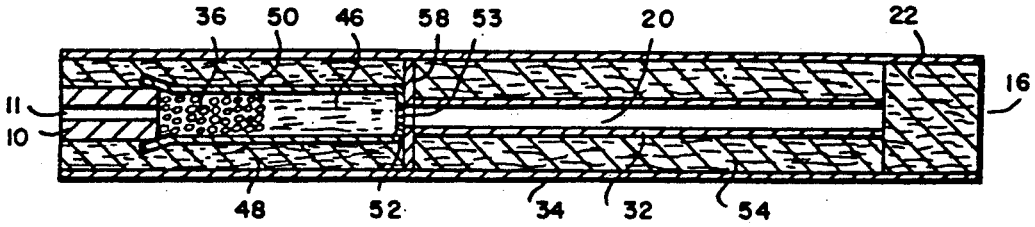

The embodiment illustrated in FIG. 5 is similar to that of FIG. 4, except that the insulating jacket 48 only extends as far as the mouth end of metallic container 50 and a section of cellulose acetate tow 54 is used to surround plastic tube 32. The end of this section 58, adjacent the insulating jacket, is fused or sealed to prevent air passage through the tow.

Upon puffing the aforesaid embodiment, air enters hole 11 in burning fuel element 10, increasing the rate of burning, and generating the heat used to volatilize the aerosol forming substance or substances present in aerosol generating means. The insulating means tends to confine, direct, and concentrate the heat toward the central core of the article, thereby increasing the heat transferred to the aerosol forming substance. In most embodiments, transfer of the heat is also assisted by the fact that the fuel element and the means for generating aerosol are in a conductive heat transfer relationship.

The aerosol thus formed is then drawn down passage 20 toward the mouth end 16, and into the user's mouth, akin to the smoke of a conventional cigarette.

During smolder, the fuel element continues to burn, but at a slower rate, and with less heat being transferred to the aerosol generating means. During this phase, heat transfer is directed by the insulating means, which prevents rapid heat loss from the periphery of the fuel element.

Because the aerosol forming substance in the preferred embodiments is physically separate from the fuel element, it is exposed to substantially lower temperatures than are generated by the burning fuel, thereby minimizing the possibility of thermal degradation of the aerosol former. This also results in aerosol production during puffing with little or no aerosol production during smolder. In addition, the use of a carbonaceous fuel element eliminates the presence of substantial pyrolysis or incomplete combustion products and the presence of substantial sidestream smoke.

If a charge of tobacco is employed, hot vapors are swept through the tobacco to extract and distill the volatile components from the tobacco, without combustion or substantial pyrolysis. Thus, the user receives an aerosol which contains the tastes and flavors of natural tobacco without the tobacco combustion products produced by a conventional cigarette.

Because of the small size of the carbonaceous fuel element preferably employed in the present invention, the fuel element usually burns over substantially all of its exposed surface area within a few puffs. Thus, that portion of the fuel element adjacent to aerosol generator becomes hot quickly, thereby significantly increasing heat transfer to the aerosol generator, especially during the early and middle puffs. Because the preferred fuel element is so short, there is never a long section of nonburning fuel to act as a heat sink, as was common in previous thermal aerosol articles. Heat transfer, and therefor aerosol delivery, also is enhanced by the use of holes through the fuel, which draw hot air to the aerosol generator, especially during puffing.

In the preferred embodiments of the invention, short carbonaceous fuel element, insulating means, and passages in the fuel cooperate with the aerosol generator to provide a system which is capable of producing substantial quantities of aerosol on virtually every puff. The close proximity of the fire cone to the aerosol generator after a few puffs, together with the insulating means, results in high heat delivery during both puffing and during the relatively long period of smolder between puffs.

While not wishing to be bound by theory, it is believed that the aerosol generator is maintained at relatively high temperatures between puffs and that the additional heat delivered during puffs, which is significantly increased by the hole or holes in the fuel element, is primarily utilized to vaporize the aerosol forming substance. This increased heat transfer makes more efficient use of the available fuel energy, reduces the amount of fuel needed, and helps deliver early aerosol. Further, the conductive heat transfer utilized in the preferred embodiments of the present invention is believed to reduce the carbon fuel combustion temperature which, it is further believed, reduces the $CO/CO_2$ ratio in the combustion products produced by the fuel. See, e.g., C. Hagg, *General Inorganic Chemistry,* at p. 592 (John Wiley & Sons, 1969).

Furthermore, by the appropriate selection of the fuel element, the insulating jacket, the paper overwrap, and the heat conducting means, it is possible to control the burn properties of the fuel source. This provides opportunities for control of heat transfer to the aerosol generator, which in turn, alters the number of puffs and/or the amount of aerosol delivered to the user.

The preferred fuel elements are primarily formed of a carbonaceous material. Preferably, the carbon content of the fuel is at least 80%, most preferably about 90%, or more by weight. High carbon content fuels are preferred because they produce minimal pyrolysis and incomplete combustion products, little or no visible sidestream smoke, and minimal ash. However, lower carbon content fuel elements are within the scope of this invention, especially where a nonburning inert filler is employed.

The carbonaceous materials used in or as the fuel element may be derived from virtually any of the numerous carbon sources known to those skilled in the art. Preferably, the carbonaceous material is obtained by the pyrolysis or carbonization of cellulosic materials, such as wood, cotton, rayon, tobacco, coconut, paper, and the like, although carbonaceous materials from other sources may be used.

The carbonaceous fuel elements which are preferably employed in practicing the invention are generally less than about 30 mm long. Advantageously the fuel element is about 20 mm or less in length, preferably about 15 mm or less in length. In more preferred embodiments, the fuel element is between about 8 mm to about 12 mm in length. Advantageously, the diameter of the fuel element is between about 3 to 8 mm, preferably about 4 to 5 mm. The density of the fuel elements employed herein has varied from about 0.5 g/cc to about 1.5 g/cc. Preferably, the density is greater than 0.7 g/cc. Carbonaceous fuel elements having these characteristics are sufficient to provide at least about 7 to 10 puffs, the number of puffs generally obtained with a conventional cigarette when smoked using standard FTC conditions. Preferably, the fuel is provided with one or more longitudinally extending holes, such as holes 11 in FIGS. 1 through 5. These holes provide porosity and increase early heat transfer to the substrate by increasing the amount of hot gases which reach the substrate.

In most instances, the carbonaceous material should be capable of being ignited by a conventional cigarette lighter without the use of an oxidizing agent. Burning characteristics of this type may generally be obtained from a cellulosic material which has been pyrolyzed at temperatures between about 400 deg. C. to about 1000 deg. C., preferably between about 500 deg. C. to about 950 deg. C., in an inert atmosphere or under a vacuum. The pyrolysis time is not believed to be critical, as long as the temperature at the center of the pyrolyzed mass has reached the aforesaid temperature range for at least a few minutes. However, a slow pyrolysis, employing gradually increasing temperatures over several hours is believed to produce a more uniform material with a higher carbon yield.

While undesirable in most cases, carbonaceous materials which require the use of an oxidizing agent to render them ignitable by a cigarette lighter are within the scope of this invention, as are carbonaceous materials which require the use of a glow retardant or other type of combustion modifying agent. Such combusion modifying agents are dislosed in many patents and publications and are well known to those of ordinary skill in the art.

The carbonaceous fuel elements used in practicing the invention are substantially free of volatile organic material. By that, it is meant that the fuel element is not purposely impregnated or mixed with substantial amounts of volatile organic materials, such as volatile aerosol forming or flavoring agents, which could degrade in the burning fuel. However, small amounts of water, which are naturally adsorbed by the carbon in the fuel element, may be present therein. While undesirable, small amounts of aerosol forming substances may migrate from the aerosol generator and thus may also be present in the fuel.

A preferred carbonaceous fuel element is a pressed or extruded mass of carbon prepared from carbon and a binder, by conventional pressure forming or extrusion techniques. A preferred activated carbon for such a fuel element is PCB-G, and a preferred nonactivated carbon is PXC, both available from Calgon Carbon Corporation, Pittsburgh, PA. Other preferred nonactivated carbons for pressure forming are prepared from pyrolized cotton or pyrolized papers, such as Grande Prairie Canadian Kraft, available from the Buckeye Cellulose Corporation of Memphis, TN.

The binders which may be used in preparing such a fuel element are well known in the art. A preferred binder is sodium carboxymethylcellulose (SCMC), which may be used alone, which is preferred, or in conjunction with materials such as sodium chloride, vermiculite, bentonite, calcium carbonate, and the like. Other useful binders include gums, such as guar gum, and other cellulose derivatives, such as methylcellulose and carboxymethylcellulose (CMC).

A wide range of binder concentrations can be utilized. Preferably, the amount of binder is limited to minimize contribution of the binder to undesirable combustion products. On the other hand, sufficient binder must be included to hold the fuel element together during manufacture and use. The amount used will thus depend on the cohesiveness of the carbon in the fuel.

In general, the pressed fuel is prepared by admixing from about 50 to 99 weight percent, preferably about 80 to 95 weight percent, of the carbonaceous material, with from 1 to 50 weight percent, preferably about 5 to 20 weight percent of the binder, with sufficient water to make a paste. The paste is homogenized by mixing and then dried to reduce the moisture content to about 5 to 10 weight percent. The dried paste is then ground to a particle size of less than about 20 mesh size. This ground material is treated with water to raise the moisture level to about 30 weight percent, and the moist solid is fed to forming means, such as a conventional pill press, wherein a die punch pressure of from 1,000 pounds (455 kg) to 10,000 pounds (4550 kg) preferably about 5,000 pounds (2273 kg), of load is applied to create a pressed pellet having the desired dimensions. The pressed pellet is then dried at from about 55 deg. C. to about 100 deg. C. to reduce the moisture content to between 5 to 10 weight percent. The longitudinal passage or passages, if desired, may be drilled using conventional techniques, or they may be formed at the time of pressing.

Preferably, the forming means used is a standard extruder. In that case, the ingredients described supra are used but the amount of water employed is just sufficient to obtain a stiff dough consistency. The dough is then extruded into the desired shape and dried.

If desired, the aforesaid carbon fuel elements may be pyrolyzed after formation, for example, to about 650 deg. C. for two hours, to convert the binder to carbon and thereby form a virtually 100% carbon fuel source.

The carbon fuel elements also may contain one or more additives to improve burning, such as up to about 5 weight percent of sodium chloride to improve smoldering characteristics and as a glow retardant. Also, up to about 5 weight percent of potassium carbonate may be included to improve lightability. Additives to improve physical characteristics, such as clays like kaolins, serpentines, attapulgites, and the like also may be used.

Another preferred carbonaceous fuel element is a carbon fiber fuel, which may be prepared by carbonizing a fibrous precursor, such as cotton, rayon, paper, polyacrylonitile, and the like. Generally, pyrolysis at about 650 deg. C. to 1000 deg. C., preferably about deg. C., for about 30 minutes, in an inert atmosphere or vacuum, is sufficient to produce a suitable carbon fiber with good burning characteristics. Combustion modifying additives also may be added to these preferred fuels.

The insulating means used in practicing this invention may be selected from any materials which act primarily as insulators. Preferably, these materials do not burn during use, but they may include slow burning carbons and like materials, as well as materials which fuse during use, such as low temperature grades of glass fibers. Such materials generally include inorganic fibers such as those made out of glass, alumina, silica, vitreous materials, carbons, silicons, boron, and the like, including mixtures of these materials, and the like. Several commercially available insulating fibers are prepared with a binder e.g., PVA, which acts to maintain structural integrity during handling. These binders should be removed, e.g., by heating in air at about 650 deg. C. for up to about 15 min. before use herein.

The currently preferred insulating fibers are ceramic fibers, such as glass fibers. Two especially preferred glass fibers are available from the Manning Paper Company of Troy, N.Y., under the designations, Manniglas 1000 and Manniglas 1200. Generally the insulating fiber is wrapped over at least a portion of the fuel element and any other desired portion of the article, to a final diameter of from about 7 to 8 mm. Thus, the preferred thickness of the insulating layer is from about 0.5 mm to 2.5 mm, preferably, from about 1 mm to 2 mm.

The aerosol generating means used in practicing this invention is physically separate from the fuel element. By physically separate it is meant that the aerosol generator which contains the aerosol forming materials is not mixed with, or a part of, the fuel. As noted previously, this arrangement helps reduce or eliminate thermal degradation of the aerosol forming substance and the presence of sidestream smoke. While not a part of the fuel, the aerosol generator preferably abuts or is adjacent to the fuel element so that the fuel and the aerosol generator are in a heat exchange relationship.

Preferably, the aerosol generating means contains one or more thermally stable materials which carry one or more aerosol forming substances. As used herein, a thermally stable material is one capable of withstanding the hi9h temperatures, e.9., 400 deg. C. to about 600 deg. C., which may eventually exist near the fuel without decomposition or burning. The use of such material is believed to help maintain the simple "smoke" chemistry of the aerosol, as evidenced by the lack of Ames activity. While not preferred, other aerosol generating means, such as heat rupturable microcapsules, or solid aerosol forming substances, are within the scope of this invention, provided they are capable of releasing aerosol forming vapors.

Thermally stable materials which may be used as the carrier or substrate for the aerosol forming substance are well known to those skilled in the art. Useful carriers should be porous, and must be capable of retaining an aerosol forming compound and releasing a potential aerosol forming vapor upon heating by the fuel. Useful thermally stable materials include thermally stable adsorbent carbons, such as electrode grade carbons, graphite, activated, or nonactivated carbons, and the like. Other suitable materials include inorganic solids such as ceramics, alumina, vermiculite, clays such as bentonite, glass beads, and the like. The currently preferred substrate materials are carbon felts, fibers, and mats, made from activated or nonactivated carbons, or porous carbons such as PC-25 and PC-60 available from Union Carbide, Danbury, Conn., as well as SGL carbon available from Calgon.

The aerosol generating means used in the invention is usually no more than about 60 mm, preferably, no more than 30 mm, most preferably no more than 15 mm from the lighting end of the fuel element. The aerosol generator may vary in length from about 2 mm to about 60 mm, preferably from about 5 mm to 40 mm, and most preferably from about 20 mm to 35 mm.

The aerosol forming substance or substances used in the invention must be capable of forming an aerosol at the temperature present in the aerosol generating means upon heating by the burning fuel element. Such substances preferably will be composed of carbon, hydrogen and oxygen, but they may include other materials. The boiling point of the substance and/or the mixture of substances can range up to about 500 deg. C. Substances having these characteristics include polyhydric alcohols, such as glycerin and propylene glycol, as well as aliphatic esters of mono-, di-, or poly-carboxylic acids, such as methyl stearate, dimethyl dodecandioate, dimethyl tetradecandicoate, and others.

Preferably, the aerosol forming substances will include a mixture of a high boiling, low vapor pressure substance and a low boiling, high vapor pressure substance. Thus, on early puffs, the low boiling substance will provide most of the initial aerosol, while, when the temperature in the aerosol generator increases, the high boiling substance will provide most of the aerosol.

The preferred aerosol forming substances are polyhydric alcohols, or mixtures of polyhydric alcohols. A more preferred aerosol former is a mixture of glycerin and propylene glycol, which substances are present in a weight ratio of from 1:10 to 10:1, preferably, from 1:4 to 4:1.

When a substrate material is employed as a carrier, the aerosol forming substance may be dispersed on or within the substrate in a concentration sufficient to permeate or coat the material, by any known technique. For example, the aerosol forming substance may be applied full strength or in a dilute solution by dipping, spraying, vapor deposition, or similar techniques. Solid aerosol forming components may be admixed with the substrate material and distributed evenly throughout prior to formation of the final substrate.

While the loading of the aerosol forming substance will vary from carrier to carrier and from aerosol forming substance to aerosol forming substance, the amount of liquid aerosol forming substances may generally vary from about 20 mg to about 120 mg, preferably from about 35 mg to about 85 mg, and most preferably from about 45 mg to about 65 mg. As much as possible of the aerosol former carried on the substrate should be delivered to the user as WTPM. Preferably, above about 2 weight percent, more preferably above about 15 weight percent, and most preferably above about 20 weight percent of the aerosol former carried on the substrate is delivered to the user as WTPM.

The aerosol generating means also may include one or more volatile flavoring agents, such as menthol, vanillin, artificial coffee, tobacco extracts, nicotine, caffeine, liquors, and other agents which impart flavor to the aerosol. It also may include any other desirable volatile solid or liquid materials. Alternatively, these optional agents may be placed between the aerosol generator and the mouth end, such as in a separate substrate or chamber in passage 26 which connects the aerosol generator to the mouthend, or in the optional tobacco charge. If desired, these volatile agents may be used in lieu of part, or all, of the aerosol forming substance, so that the article delivers a nonaerosol flavor or other material to the user.

Articles of the type disclosed herein may be used or may be modified for use as drug delivery articles, for delivery of volatile pharmacologically or physiologically active materials such as ephedrine, metaproterenol, terbutaline or the like.

The heat conducting member preferably employed in practicing this invention is typically a metallic foil, such as an aluminum foil, varying in thickness from less than about 0.01 mm to about 0.1 mm, or more. The thickness and/or the type of conducting material may be varied to achieve virtually any desired degree of heat transfer. As shown in the illustrated embodiments, the heat conducting member preferably contacts or overlaps a portion of the fuel element, and may form the container which encloses the aerosol forming substance.

In most embodiments of the invention, the fuel and aerosol generator will be attached to a mouthend piece, although a mouthend piece may be provided separately, e.g., in the form of a cigarette holder. This element of the article provides the passage which channels the vaporized aerosol forming substance into the mouth of the user.

Suitable mouthend pieces should be inert with respect to the aerosol forming substances, should have a water or liquid proof inner layer, should offer minimum aerosol loss by condensation or filtration, and should be capable of withstanding the temperature at the interface with the other elements of the article. Preferred mouthend pieces include the cellulose acetate-polypropylene tube of FIGS. 2, 3 & 5. Other suitable mouthend pieces will be apparent to those of ordinary skill in the art.

The mouthend pieces of the invention may include an optional "filter" tip, which is used to give the article the appearance of the conventional filtered cigarette. Such filters include low density cellulose acetate filters and hollow or baffled plastic filters, such as those made of polypropylene. In addition, the entire length of article or any portion thereof may be overwrapped with cigarette paper. Preferred papers should not openly flame during burning of the fuel element, should produce a grey, cigarette-like ash, and should have sufficient porosity to provide peripheral air flow through the preferred insulating fibers to support combustion of the fuel element during smolder. One such paper is ECUSTA 01788, produced by Ecusta of Pisgah Forest, NC.

The aerosol produced by the preferred articles of the present invention is chemically simple, consisting essentially of air, oxides of carbon, the aerosol which carries any desired flavors or other desired volatile materials, water, and trace amounts of other materials. The WTPM produced by the preferred articles of this invention has no mutagenic activity as measured by the Ames Test, i.e., there is no significant dose response relationship between the WTPM of the present invention and the number of revertants occurring in standard test microorganisms exposed to such products. According to the proponents of the Ames Test, a significant dose dependent response indicates the presence of mutagenic materials in the products tested. See Ames et al., *Mut. Res.*, 31:347–364 (1975); Nagao et al., *Mut. Res.*, 42:335 (1977).

A further benefit from the preferred embodiments of the present invention is the relative lack of ash produced during use in comparison to ash from a conventional cigarette. As the preferred carbon fuel source is burned, it is essentially converted to oxides of carbon, with relatively little ash generation, and thus there is no need to dispose of ashes while using the article.

The smoking article of the present invention will be further illustrated with reference to the following examples which aid in the understanding of the present invention, but which are not to be construed as limitations thereof. All percentages reported herein, unless otherwise specified, are percent by weight. All temperatures are expressed in degrees Celsius and are uncorrected. In all instances, the articles have a diameter of about 7 to 8 mm, the diameter of a conventional cigarette.

Example 1

A smoking article was constructed in accordance with the embodiment of FIG. 1 in the following manner. Saffil alumina low density fibers were obtained from ICI Americas, Inc. in mat form. These fibers were 95% $Al_2O_3$, 5% $SiO_2$, and had a fiber diameter of from 2 to 4 microns. The mat was slit to a width such that long narrow bands of the material could be fed through a conventional cigarette filter maker. The filter maker compressed the mat while wrapping it with a conventional cigarette plug wrap. The resulting product was a continuous rod of Saffil alumina fibers with an appearance similar to that of a conventional cellulose acetate cigarette filter. These rods were cut to 10 mm length. A boring tool was used to form a 4 mm diameter passageway through the center of the alumina segments. A 10 mm long carbon fuel source of approximately 4.5 mm o.d. was inserted into the passageway of the alumina segment such that the alumina fibers formed an insulating, resilient jacket around the fuel source. The fuel source was 90% PCB-G, obtained from Calgon Corp., and 10% SCMC formed at a pressure of about 5000 pounds (2273 k9) of applied load. A passageway of 1.02 mm diameter extended through the fuel source. The jacketed fuel source was inserted aproximately 2 mm inside a foil-lined paper tube obtained from Neimand, Inc , Statesville, N.C. This tube consisted of a 0.35 mil (0.0089 mm) layer of aluminum foil inside a 4.25 mil (0.108 mm) layer of white spirally wound paper. A substrate piece was abutted against the jacketed fuel source. The substrate was formed from Union Carbide's PC-25 material. It was machined to a length of about 10 mm and a diameter of about 7–8 mm with a continuous central passageway of about 0.016 inch (0.4 mm) diameter. Approximately 60 mg of a solution of glycerin and propylene glycol (1:1 ratio) were applied to the substrate. A cellulose acetate filter piece of approximately 10 mm length was inserted into the mouth end of the foil-lined tube.

The model showed improved ease-of-lighting when compared to a similar smoking article without the alumina jacket. The carbon fuel source glowed red even between puffs. Aerosol delivery was low on the initial three puffs and increased greatly on subsequent puffs. Overall appearance was greatly improved. The insulating effects of the ceramic fiber jacket were evidenced by substantially lower peripheral heat loss.

Example 2

A modified version of the article shown in FIG. 3 was made in the following manner. A 10 mm long carbon fuel source of 4.5 mm diameter with a 1 mm diameter central hole was extruded from a mixture of 10% SCMC, 5% potassium carbonate, and 85% carbonized paper mixed with an equal amount of water. The mixture had a dough-like consistancy and was fed into an extruder. The extruded material was cut to length after drying at 80 deg. C. overnight. The metallic container for the substrate was made from a 22 mm long piece of 0.0089 mm thick aluminum, formed into a cylinder of 4.5 mm inner diameter. One end of this chamber was crimped to form an end wall having a small central hole, as shown in FIG. 4. The metallic chamber was filled with (a) 70 mg of vermiculite containing 50 mg of a 1:1 mixture of propylene glycol and glycerin, and (b) 30 mg of Burley tobacco to which 6% glycerine and 6% propylene glycol had been added. The fuel source and the metallic container were joined by inserting the fuel source about 2 mm into one end of the metallic container. A 35 mm long polypropylene tube of 4.5 inner diameter was inserted over the other end of the metallic container. The fuel source, metallic container and polypropylene tube were thus joined to form a 65 mm long, 4.5 mm diameter segment. This segment was wrapped with several layers of Manniglas 1000 from the Manning Paper Company, until a circumference of about 24.7 mm was reached (i.e., the circumference of a conventional cigarette.) The unit was then combined with a 5 mm long cellulose acetate filter and overwrapped with cigarette paper. When smoked using standard FTC conditions, the article delivered 8 mg of WTPM over the initial three puffs; 7 mg WTPM over puffs 4–6; and 5 mg WTPM over puffs 7–9. Total aerosol delivery over the 9 puffs was 20 mg. When ignited and placed horizontally on a piece of tissue paper, articles of this type neither ignited nor scorched the tissue paper.

Example 3

The smoking article illustrated in FIG. 4 was made from an extruded carbon fuel source in the following manner.

A. Fuel Source Preparation

Grand Prairie Canadian Kraft paper made from hardwood and obtained from Buckeye Cellulose Corp., Memphis, Tenn., was shredded and placed inside a 9" diameter, 9" deep stainless steel furnace. The furnace chamber was flushed with nitrogen, and the furnace temperature was raised to 200 deg. C. and held for 2 hours. The temperature in the furnace was then increased at a rate of 5 deg. C. per hour to 350 deg. C. and was held at 350 deg. C. for 2 hours. The temperature of the furnace was then increased at 5 deg. C. per hour to 650 deg. C. to further pyrolize the cellulose. Again the furnace was held at temperature for 2 hours to assure uniform heating of the carbon. The furnace was then cooled to room temperature and the carbon was ground into a fine powder (less than 400 mesh) using a "Trost" mill. This powdered carbon had a tapped density of 0.6 grams/cubic centimeter and hydrogen plus oxygen level of 4%.

Nine parts of this carbon powder was mixed with one part of SCMC powder and water was added to make a thin slurry, which was then cast into a sheet and dried. The dried sheet was then reground into a fine powder and sufficient water was added to make a plastic mix which was stiff enough to hold its shape after extrusion, e.g., a ball of the mix will show only a slight tendency to flow in a one day period. This plastic mix was then loaded into a room temperature batch extruder. The female extrusion die for shaping the extrudant had tapered surfaces to facilitate smooth flow of the plastic mass. A low pressure (less than 5 tons per square inch or $7.03\times10^6$ kg per square meter) was applied to the plastic mass to force it through a female die of 4.6 mm diameter. The wet rod was then allowed to dry at room temperature overnight. To assure that it was completely dry it was then placed into an oven at 80 deg. C. for two hours. This dried rod had a density of 0.6 gm/cc, a diameter of 4.5 mm, and an out of roundness of approximately 3%.

The dry, extruded rod was cut into 10 mm lengths and three 0.5 mm holes were drilled through the length of the rod as illustrated in FIG. 4A. The end of the rods which were to be ignited were then machined to a diameter of about 3 mm to facilitate ease of lighting.

B. Assembly

The metallic containers for the substrate were 30 mm long spirally wound aluminum tubes obtained from Niemand, Inc., having a diameter of about 4.5 mm. One end of each of these tubes was crimped to form an end with a small hole. Approximately 180 mg of PG-60, a granulated carbon obtained from Union Carbide, was used to fill each of the containers. This substrate material was loaded with approximately 75 mg of a 1:1 mixture of glycerin and propylene glycol. After the metallic containers were filled, each was joined to a fuel rod by inserting about 2 mm of the fuel rod into the open end of the container. Each of these units was then joined to a 35 mm long polypropylene tube of 4.5 mm internal diameter by inserting one end of the tube over the walled end of the container.

Each of these core units was placed on a sheet of Manniglas 1200 pretreated at about 600 deg. C. for up to about 15 min. in air to eliminate binders, and rolled until the article was aproximately the circumference of a cigarette. An additional double wrap of Manniglas 1000 was applied around the Mannigals 1200. The ceramic fiber jacket was cut away from the mouth end 10 mm of the polypropylene tube so that a 10 mm long annular segment of cellulose acetate filter material could be placed over the polypropylene tube. The mouth end of this segment was heavily coated with a conventional adhesive to block air flow through the filter material. A conventional cellulose acetate filter plug of 10 mm length was butted against the adhesive. The entire unit was then wrapped with ECUSTA 01788 perforated cigarette paper, and a conventional tipping paper was applied to the mouth end.

Smoking articles with three holes in the fuel rod, as shown in FIG. 4A, demonstrated increased aerosol on the immediate second puff (i.e., a puff taken immediately after the lighting puff) when compared to an article with a single hole fuel source. Smoking articles made with more than three holes, such as the 9 hole rod shown in FIG. 4B and the "pie" shaped hole configuration of FIG. 4C produced even more aerosol on the immediate second puff, with the 9 hole embodiment producing remarkably increased immediate second puff aerosol when compared to single hole fuel sources.

Similar smoking articles have been prepared with tobacco, either mixed with or used in lieu of the substrate, with similar results.

Example 4

The smoking article illustrated in FIG. 4 was made from an all carbon extruded fuel source in the following manner. An extruded fuel source was made as outlined in Example 3A with the exception that an internal mandrel was used to form 4 holes of roughly triangular i.e., "pie" shape in the fuel source, as shown in FIG. 4C. The fuel source thus had a cross shaped web of about 0.75 mm and an outer wall of about 1 mm. A rod of this material was coated on the exterior surface with a mixture of Shell 815 epoxy and Magnolia 544-A hardening agent. The rod was heated to 150 deg. C. for 30 minutes to cure the epoxy. The rod was then heated in a tube furnace to 650 deg. C. in approximately 30 minutes in a nitrogen atmosphere to carbonize the SCMC and epoxy. The resultant all carbon fuel was cut to a 10 mm length, which weighed 0.092 grams. This fuel rod was formed into a smoking article in the manner described in Example 3B. The lighting and burning characteristics of this all carbon structure was not significantly different from the SCMC containing fuel sources employed in Example 3.

Example 5

Additional smoking articles were prepared in accordance with the provisions of Example 3, with a specially prepared glass fiber material obtained from Owens-Corning Fiberglas of Toledo, Ohio, formed into a glass fiber paper, having a thickness of about 0.005 inches (5 mils) (ASTM Method D 647, using a low pressure PMI guage (7.3 psi)). This was used in place of the Manniglas materials. Use of this alkali-borosilicate material, having a 679 deg. C. softening point, and a fiber diameter of about 9 microns afforded a ceramic jacket having several layers , which fused to a porous mass upon heating by the burning fuel element. This fused mass was acceptable in appearance, i.e., the article retained a cigarette-like shape while producing aerosol in quantities similar to the previous examples.

What is claimed is:

1. A smoking article comprising:

(a) a fuel element;

(b) a physically separate aerosol generating means longitudinally disposed relative to the fuel element containing at least one aerosol forming substance; and (c) a resilient insulating member, at least 0.5 mm thick, encircling substantially the entire length of the fuel element; said fuel element, insulating member, and aerosol generating means being arranged such that heat is directed from the burning fuel element to the aerosol generating means throughout the burning of the fuel element.

2. The smoking article of claim 1, wherein the insulating member is at least 1 mm thick.

3. The smoking article of claim 1, wherein the insulating member comprises an air permeable resilient jacket of inorganic fibers.

4. The smoking article of claim 1, wherein conductive heat is transferred from the burning fuel element to the aerosol forming substance.

5. The smoking article of claim 1, further comprising a heat conducting member which contacts at least a portion of the fuel element and at least a portion of the aerosol generating means.

6. The smoking article of claim 1, wherein the fuel element is a carbonaceous material, less than 30 mm in length prior to smoking.

7. A smoking article comprising:

(a) a fuel element;

(b) a physically separate aerosol generating means containing one or more aerosol forming substances, the aerosol generating means being longitudinally disposed relative to the fuel element;

(c) a separate mouthend piece including a filter;

(d) an insulating means surrounding at least a portion of said fuel element; and (e) a paper wrapper overlapping at least a portion of the longitudinal periphery of the article;

said fuel element, insulating means, and aerosol generating means being arranged such that heat is directed from the burning fuel element to the aerosol generating means throughout the burning of the fuel element.

8. The smoking article of claim 7, wherein the insulating means has a thermal conductivity of less than about 0.05 g-cal/(sec)(cm$^2$)(° C./cm).

9. The smoking article of claim 7, wherein the insulating means is at least 0.5 mm thick.

10. The smoking article of claim 7, wherein the insulating means is at least 1 mm thick.

11. The smoking article of claim 7, wherein the insulating means comprises a resilient jacket of inorganic fibers.

12. The smoking article of claim 7, wherein conductive heat is transferred from the burning fuel element to the aerosol forming substance.

13. The smoking article of claims 7, 8, 9, or 11, further comprising a heat conducting member, which member contacts at least a portion of the fuel element and at least a portion of the aerosol generating means.

14. The smoking article of claim 7, wherein the aerosol generating means comprises a metallic container.

15. The smoking article of claim 7, wherein the insulating means further surrounds at least a portion of said aerosol generating means.

16. A cigarette-type smoking article comprising:

(a) a carbonaceous fuel element;

(b) a physically separate aerosol generating means containing one or more aerosol forming substances, said means being disposed longitudinally behind said fuel element and (c) a noncombustible insulating member surrounding more than half of the length of said fuel element.

17. The smoking article of claim 16, wherein the insulating member has a thermal conductivity of less than about 0.05 g-cal/(sec)(cm$^2$)(° C./cm).

18. A cigarette-type smoking article comprising:
(a) a carbonaceous fuel element;
(b) a physically separate aerosol generating means containing one or more aerosol forming substances, the aerosol generating means being longitudinally disposed relative to the fuel element;
(c) a separate mouthend piece including a filter;
(d) an insulating member surrounding at least a portion of said fuel element; and
(e) a paper wrapper overlapping at least a portion of the longitudinal periphery of the article;
wherein said fuel element, insulating member, and aerosol generating means being arranged such that heat is directed from the burning fuel element to the aerosol generating means throughout the burning of the fuel element.

19. The smoking article of claim 16 or 18 which further comprises a heat conductive member, which member contacts at least a portion of said fuel element and at least a portion of said aerosol generating means.

20. The article of claim 1, 3, 7, 11, 16, or 19, wherein the insulating means comprises inorganic fibers that fuse during use.

21. The smoking article of claim 16, or 18 wherein the fuel element is less than 30 mm in length prior to smoking.

22. The smoking article of claim 16 or 18, wherein the insulating member comprises an air permeable resilient jacket of fibers.

23. The smoking article of claim 22, wherein the thickness of said resilient jacket of fibers is at least 0.5 mm.

24. The smoking article of claim 16, or 18, wherein the insulating member further surrounds at least a portion of the aerosol generating means.

25. The article of claim 1, 3, 5, 7, 11, 16 or 19, wherein the insulating means comprises a material which fuses during use.

26. A smoking article comprising:
(a) a fuel element;
(b) an aerosol generating means containing at least one aerosol forming substance; and
(c) a resilient insulating member, at least 0.5 mm thick, surrounding at least a portion of the fuel element; said fuel element, insulating member, and aerosol generating means being arranged such that heat is directed from the burning fuel element to the aerosol generating means throughout the burning of the fuel element, and wherein the insulating member comprises an air permeable jacket of inorganic fibers.

27. A smoking article comprising:
(a) a fuel element;
(b) an aerosol generating means containing at least one aerosol forming substance; and
(c) a resilient insulating member, at least 0.5 mm thick, surrounding at least a portion of the fuel element; said fuel element, insulating member, and aerosol generating means being arranged such that heat is directed from the burning fuel element to the aerosol generating means throughout the burning of the fuel element; and
further comprising a heat conducting member which contacts at least a portion of the fuel element and at least a portion of the aerosol generating means.

28. A cigarette-type smoking article comprising:
(a) a fuel element;
(b) an aerosol generating means containing at least one aerosol forming substance; and
(c) an insulating member, at least 0.5 mm thick, surrounding at least a portion of the fuel element; said fuel element, insulating member, and aerosol generating means being arranged such that heat is directed from the burning fuel element to the aerosol generating means throughout the burning of the fuel element; and
wherein the fuel element is a carbonaceous material, less than 30 mm in length prior to smoking.

29. A smoking article comprising:
(a) a fuel element;
(b) an aerosol generating means containing at least one aerosol forming substance; and
(c) a noncombustible insulating member, circumscribing at least a portion of the periphery of the fuel element and wherein the insulating member comprises a material which fuses during use.

30. The smoking article of claim 29, wherein the insulating member is at least 0.5 mm thick.

31. A smoking article, comprising:
(a) a carbonaceous fuel element;
(b) a physically separate aerosol generating means containing at least one aerosol forming substance; and
(c) a resilient insulating member at least 1 mm thick circumscribing at least a portion of the periphery of the fuel element, the insulating member comprising a material which fuses during use.

32. The smoking article of claim 29 or 31, wherein the insulating member comprises a low temperature grade of glass fibers.

33. The smoking article of claim 32, wherein the insulating member comprises glass fibers having a softening point of about 679° C.

34. The smoking article of claim 29 or 31, further comprising a heat conducting member for conducting heat from the fuel element to the aerosol generating means.

35. The smoking article of claim 34, wherein the fuel element is less than 30 mm in length prior to smoking.

36. The article of claim 29 or 31, wherein the insulating member comprises an air permeable mass of inorganic fibers.

37. A smoking article, comprising
(a) a carbonaceous fuel element;
(b) a physically separate aerosol generating means containing at least one aerosol forming substance;
(c) a heat conducting member for conducting heat from the fuel element to the aerosol generating means, and
(d) an insulating member at least 0.5 mm thick circumscribing at least a portion of both the fuel element and the heat conducting member.

38. The article of claim 37, wherein the insulating member is resilient.

39. The article of claim 37 or 38, wherein the insulating member fuses during use.

40. The article of claim 37 or 38, wherein the fuel element is less than 30 mm in length prior to smoking.

41. The smoking article of claim 1, 7, 16, 26, 27 28, 29, 31 or 37, wherein the insulating member has a thermal conductivity of less than about 0.005 g-cal/(sec)(cm$^2$)(° C./cm).

42. The smoking article of claim 1, 7, 16, 26, 27 28, 29 or 37, wherein the article delivers at least about 0.6 mg of wet total particulate matter in the first three puffs under standard FTC smoking conditions.

43. The smoking article of claim 42, wherein the article delivers at least about 1.5 mg of wet total particulate matter in the first three puffs under standard FTC smoking conditions.

44. The smoking article of claim 1, 7, 16, 26, 27 28, 29, 31, or 37, wherein the article delivers an average of at least about 0.8 mg of wet total particulate matter per puff under standard FTC smoking conditions.

45. The smoking article of claim 1, 7, 16, 26, 27 28, 29, 31 or 37 wherein the aerosol produced by the smoking device contains no significant mutagenic activity, as measured by the Ames Test.

46. The smoking article of claim 1, 16, 27, 28, 29, 31 or 37, wherein the insulating member comprises a resilient layer of insulating material.

47. A cigarette-type smoking article comprising:
(a) a fuel element less than 30 mm in length prior to smoking;
(b) a physically separate aerosol generating means containing at least one aerosol forming substance; and
(c) a resilient insulating member, at least 0.5 mm thick, surrounding at least a portion of the aerosol generating means.

48. A cigarette-type smoking article comprising:
(a) a carbonaceous fuel element;
(b) an aerosol generating means containing one or more aerosol forming substance; and
(c) a noncombustible resilient insulating member surrounding at least a portion of said aerosol generating means.

49. The article of claim 48, wherein the insulating member is at least about 0.5 mm thick.

50. The article of claim 47, 48 or 49, wherein the insulating member comprises an air permeable resilient jacket of fibers.

51. The article of claim 47, 48 or 49, wherein the insulating member also surrounds at least a portion of the fuel element.

52. The article of claim 47, 48 or 49, further comprising a heat conducting member for conducting heat from the fuel element to the aerosol generating means.

53. The article of claim 47 or 48, wherein the insulating member is at least about 1 mm thick.

54. A cigarette-type smoking article comprising:
(a) a carbonaceous fuel element;
(b) an aerosol generating means containing one or more aerosol forming substances; and
(c) a noncombustible insulating member surrounding at least one-half of the length of said fuel element, wherein the insulating member has a thermal conductivity of less than about 0.05 g-cal/(sec) ($cm^2$) (° C./cm).

55. A smoking article comprising:
(a) a carbonaceous fuel element;
(b) an aerosol generating means containing one or more aerosol forming substances;
(c) an insulating member surrounding at least a portion of said fuel element; and
(d) a heat conducting member which contacts at least a portion of said fuel element and at least a portion of said aerosol generating means.

56. The smoking article of claim 1, 7, 26, 27, 28, 29, 31, 37, or 55, wherein the smoking article has the shape and size of a cigarette.

57. The smoking article of claim 1, 3, 7, 10, 11, 26, 27, 28, 29, 31, 37, 38, 55, or 36, wherein the smoking article has the size and shape of a cigarette and the insulating member is in contact with the outer periphery of the fuel element.

58. A cigarette-type smoking article comprising:
(a) a carbonaceous fuel element;
(b) an aerosol generating means containing one or more aerosol forming substances; and
(c) an insulting member at least 0.5 mm thick circumscribing more than about one-half of the length of the fuel element.

59. The smoking article of claim 58, wherein the insulating member comprises an air permeable resilient jacket of fibers.

60. The smoking article of claim 1, 3, 7, 10, 11, 16, 19, 26, 27, 28, 29, 31, 39, 55, 58 or 36, wherein the insulating member does not burn during use.

61. A smoking article comprising:
(a) a carbonaceous fuel element;
(b) an aerosol generating means containing one or more aerosol forming substances;
(c) an insulating member surrounding at least a portion of said fuel element; and
(d) a heat conducting member which conducts heat from the fuel element to the aerosol generating means.

62. The smoking article of claim 1, 16, or 58, wherein the insulating member also surrounds at least a portion of the aerosol generating means.

63. A cigarette-type smoking article comprising:
(a) a fuel element less than 30 mm in length prior to smoking;
(b) a physically separate aerosol generating means including an aerosol forming material; and
(c) an insulating member at least 0.5 mm thick surrounding at least a portion of the periphery of the fuel element.

64. The smoking article of claim 63, wherein the fuel element is carbonaceous.

65. A smoking article comprising:
(a) a carbonaceous fuel element;
(b) a physically separate aerosol generating means including an aerosol forming substance; and
(c) an insulating member surrounding at least a portion of the fuel element; and
(d) a paper wrapper which overwraps at least a portion of the length of the article.

66. A smoking article comprising:
(a) a carbonaceous fuel element;
(b) an aerosol generating means containing at least one aerosol forming substance;
(c) an insulating member, comprising fibers which fuse during use, which circumscribes at least a portion of the periphery of the fuel element; and
(d) a paper wrapper which overwraps at least a portion of the length of the article.

67. A cigarette-type smoking article comprising:
(a) a carbonaceous fuel element at the lighting end of the article, being less than about 20 mm in length prior to smoking;
(b) a physically separate aerosol generating means longitudinally disposed behind the fuel element, containing at least one aerosol forming substance;

(c) a fibrous insulating member surrounding at least a portion of the fuel element;

(d) a charge of tobacco located between the mouth end of the fuel element and the mouth end of the article; and (e) a paper wrapper which overwraps at least a portion of the length of the article.

68. The smoking article of claim 6, 16, 18, 28, 31, 39, 54, 55, 59, 61, 66, or 67; wherein the carbonaceous fuel element contains at least about 80 percent carbon by weight.

69. The smoking article of claim 63, 65, 66 or 67, wherein the insulating member is a resilient layer at least 0.5 mm thick comprising inorganic fibers.

70. The smoking article of claim 69, wherein the fibers fuse during use.

71. The smoking article of claim 69, further comprising a charge of tobacco located between the mouthend of the fuel element and the mouthend of the article.

72. The smoking article of claim 71, wherein the fuel element is carbonaceous.

73. The smoking article of claim 63, 65, 66, or 67, further comprising a heat conducting member for conducting heat from the fuel element to the aerosol generating means.

74. The smoking article of claim 73, wherein the insulating member is a resilient layer at least 1 mm thick comprising inorganic fibers.

75. The smoking article of claim 73, further comprising a charge of tobacco located between the mouthend of the fuel element and the mouthend of the article.

76. A cigarette type smoking article comprising:

(a) a carbonaceous fuel element at the lighting end of the article;

(b) an air permeable resilient member, at least 0.5 mm thick, surrounding at least a portion of the fuel element, comprising inorganic fibers; and (c) an aerosol forming substance physically separate from the fuel element.

77. The smoking article of claim 76, wherein the lighting end of the fuel element extends beyond the resilient member.

78. The smoking article of claim 76 or 77, wherein the fuel element is less than 30 mm in length prior to smoking.

79. The smoking article of claim 78, wherein the resilient member is at least 1 mm thick.

80. The smoking article of claim 78, wherein the resilient member comprises ceramic fibers.

81. The smoking article of claim 76 or 77, wherein the diameter of the fuel element is between about 4 and 5 mm.

82. The smoking article of claim 81, wherein the thickness of the resilient member is between about 1 and about 2.5 mm.

83. The smoking article of claim 76 or 77, wherein the fuel element is less than about 20 mm in length prior to smoking.

84. The smoking article of claim 1, 3, 11, 16, 26, 27, 28, 29, 31, 37, 38, 54, 58, 59, 30, 61, 63, 76 or 77, further comprising a charge of tobacco located between the mouth end of the fuel element and the mouth end of the article.

85. The smoking article of claim 1, 3, 11, 16, 26, 27, 28, 29, 31, 37, 38, 47, 48, 54, 55, 58, 59, 30, 61, 63, 76 or 77, further comprising a paper encircling at least a portion of the length of the article.

86. A cigarette-type smoking article having a lighting end and a mouth end and comprising:

(a) a carbonaceous fuel element having a lighting end and a rear end;

(b) a physically separate aerosol generating means longitudinally disposed behind the fuel element, containing at least one aerosol forming material;

(c) a fibrous insulating member surrounding at least a portion of the fuel element; and (d) a charge of tobacco located between the rear end of the fuel element and the mouth end of the article and being physically separate from the aerosol generating means.

87. A cigarette-type smoking article having a lighting end and a mouth end and comprising:

(a) a carbonaceous fuel element;

(b) a physically separate aerosol generating means longitudinally disposed behind the fuel element, containing at least one aerosol forming material;

(c) a heat conducting member designed and arranged to transfer heat from the fuel element to the aerosol generating means substantially throughout the time of burning of the fuel element; and (d) a fibrous insulating member surrounding at least a portion of the fuel element.

88. The smoking article of claim 87, further comprising a charge of tobacco located between the mouthend of the fuel element and the mouthend of the article.

89. The smoking article of claim 86, 87 or 88, wherein the insulating member is a resilient layer at least 0.5 mm thick comprising inorganic fibers.

90. The smoking article of claim 89, wherein the fibers fuse during use.

* * * * *

UNITED STATES PATENT AND TRADEMARK OFFICE

CERTIFICATE OF CORRECTION

PATENT NO. : 5,027,836

DATED : July 2, 1991

INVENTOR(S) : Michael D. Shannon

It is certified that error appears in the above—identified patent and that said Letters Patent is hereby corrected as shown below:

On the Cover page under References Cited/Foreign Patent Documents, please add

| | | |
|---|---|---|
| 117,355 | 9/1984 | European |
| 1 431 045 | 4/1976 | United Kingdom |

On Page 2 under Other Publications, please add
Brisbane, Asbestos Cigarette

Col. 3, line 27, "du" should be --due--.
Col. 11, line 21, after "about", second occurrence, insert --950--.
Col. 11, line 66, "hi9h" should be --high--.

Col. 19, line 32, after "of" insert --inorganic--.
Col. 22, line 1, delete "28".
Col. 22, line 21, "39" should be --37--.
Col. 23, line 8, "39" should be --37--.
Col. 23, line 9, "59" should be --58--.

UNITED STATES PATENT AND TRADEMARK OFFICE

CERTIFICATE OF CORRECTION

PATENT NO. : 5,027,836

DATED : July 2, 1991

INVENTOR(S) : Michael D. Shannon

It is certified that error appears in the above-identified patent and that said Letters Patent is hereby corrected as shown below:

Col. 24, line 11, after "54" insert --55--.
line 16, "58" should be --56--.

Signed and Sealed this

Sixth Day of April, 1993

*Attest:*

STEPHEN G. KUNIN

*Attesting Officer*

*Acting Commissioner of Patents and Trademarks*